US006821933B2

(12) United States Patent
Feustel et al.

(10) Patent No.: US 6,821,933 B2
(45) Date of Patent: Nov. 23, 2004

(54) ADDITIVES FOR IMPROVING THE COLD FLOW PROPERTIES AND THE STORAGE STABILITY OF CRUDE OIL

(75) Inventors: Michael Feustel, Köngernheim (DE); Matthias Krull, Harxheim (DE); Hans-Jörg Oschmann, Scotland (GB)

(73) Assignee: Clariant International Ltd., Muttenz (CH)

( * ) Notice: Subject to any disclaimer, the term of this patent is extended or adjusted under 35 U.S.C. 154(b) by 138 days.

(21) Appl. No.: 10/311,057

(22) PCT Filed: Jun. 6, 2001

(86) PCT No.: PCT/EP01/06414

§ 371 (c)(1),
(2), (4) Date: Dec. 13, 2002

(87) PCT Pub. No.: WO01/96503

PCT Pub. Date: Dec. 20, 2001

(65) Prior Publication Data

US 2003/0171221 A1 Sep. 11, 2003

(30) Foreign Application Priority Data

Jun. 15, 2000 (DE) ..... 100 29 621
Feb. 10, 2001 (DE) ..... 101 06 146

(51) Int. Cl.[7] ..... C10M 157/00

(52) U.S. Cl. ..... 508/390; 508/409; 508/466; 508/468; 508/472; 508/585; 508/591; 208/18; 208/19

(58) Field of Search ..... 508/591, 390, 508/585

(56) References Cited

U.S. PATENT DOCUMENTS

| | | | | | |
|---|---|---|---|---|---|
| 3,567,579 | A | | 3/1971 | Hubler et al. | 176/30 |
| 3,692,676 | A | | 9/1972 | Culter et al. | 252/8.55 R |
| 3,735,770 | A | | 5/1973 | Day et al. | 137/13 |
| 4,931,164 | A | | 6/1990 | Dickakian | 208/48 AA |
| 5,039,437 | A | * | 8/1991 | Martella et al. | 508/572 |
| 5,118,875 | A | * | 6/1992 | Martella et al. | 568/727 |
| 5,200,484 | A | | 4/1993 | Reimann | 526/331 |
| 5,254,652 | A | | 10/1993 | Reimann et al. | 526/331 |
| 5,707,946 | A | * | 1/1998 | Hiebert et al. | 508/585 |
| 5,767,190 | A | | 6/1998 | Krull et al. | 524/563 |
| 5,789,510 | A | | 8/1998 | Krull et al. | 526/281 |
| 5,939,365 | A | * | 8/1999 | Redpath et al. | 508/467 |
| 5,998,530 | A | | 12/1999 | Krull et al. | 524/474 |
| 6,133,209 | A | | 10/2000 | Rath et al. | 508/448 |
| 6,475,963 | B1 | * | 11/2002 | Bloch et al. | 508/467 |

FOREIGN PATENT DOCUMENTS

| | | |
|---|---|---|
| CN | 1 175 614 | 3/1998 |
| DE | 2 057 168 | 7/1971 |
| DE | 34 43 475 | 5/1986 |
| DE | 196 20 116 | 10/1997 |
| DE | 196 20 119 | 10/1997 |
| EP | 0 176 641 | 9/1986 |
| EP | 0 203 554 | 12/1986 |
| EP | 0 254 284 | 1/1988 |
| EP | 0 271 738 | 6/1988 |
| EP | 0 311 452 | 4/1989 |

(List continued on next page.)

OTHER PUBLICATIONS

English abstract for DE 3443475, May 28, 1986.
English abstract for EP 0203554, Dec. 3, 1986.
English abstract for EP 0254284, Jan. 27, 1988.
English abstract for EP 0271738, Jun. 22, 1988.
English abstract for EP 0405270, Jan. 2, 1991.
English abstract for EP 0491225, Jun. 24, 1992.
English abstract for CN 1175614, Mar. 11, 1998.
Rompp Chemie Lexikon, 9. Auflage, Thieme Verlag, 1988–92, Bd. 4, pp. 3351–3354.
Ullmann's Encyclopedia of Industrial Chemistry, Auflage 5, vol. A21, pp. 305–413.

*Primary Examiner*—Ellen M. McAvoy
(74) *Attorney, Agent, or Firm*—Richard P. Silverman

(57) ABSTRACT

The invention relates to additives for improving the flowability of mineral oils, containing:

A) 1–40 wt. % of at least one copolymer, which is oil-soluble and improves the cold flow properties of mineral oil, selected from A1) copolymers consisting of 80 to 96.5 mol % ethylene and 3.5–20 mol % vinyl esters of carboxylic acids with 1–20 C atoms and/or (meth)acrylic acid esters of alcohols with 1–8 C atoms, and A2) homopolymers or copolymers of esters, containing $C_{10}$–$C_{30}$ alkyl radicals, of ethylenically unsaturated carboxylic acids with up to 20 mol % of other olefinically unsaturated compounds, B) 20–80 wt. % of at least one poly-alpha-olefin with a molecular weight of 250–5000, derived from monoolefins with 3–5 C atoms, and C) 5–70 wt. % of at least one organic acid selected from C1) alkylphenol-aldehyde resins of formula (1), (1)

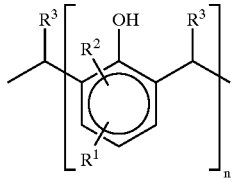

wherein $R^1$ and $R^2$ independently designate H or alkyl radicals with 1–30 C atoms, but both radicals do not at the same time signify H, n represents an integer of 3–50, and $R^3$ represents H or an alkyl radical with 1–4 C atoms, and C2) aliphatic and/or aromatic sulfonic acids of formula $R^{18}$—$SO_3H$, wherein $R^{18}$ stands for $C_6$–$C_{40}$-alkyl, $C_6$–$C_{40}$-alkenyl, or an alk(en)yl aryl radical which has 1, 2, 3 or 4 aromatic rings and 1, 2, 3 or 4 alkyl or aryl radicals with respectively 6–40 C-atoms.

11 Claims, No Drawings

FOREIGN PATENT DOCUMENTS

| | | |
|---|---|---|
| EP | 0 393 768 | 10/1990 |
| EP | 0 405 270 | 1/1991 |
| EP | 0 463 518 | 1/1992 |
| EP | 0 491 225 | 6/1992 |
| EP | 0 493 769 | 7/1992 |
| EP | 0 572 273 | 1/1993 |
| EP | 0 837 122 | 4/1998 |
| EP | 0 857 776 | 8/1998 |
| GB | 2 305 437 | 4/1997 |
| WO | WO 93/08243 | 4/1993 |
| WO | WO 98/20053 | 5/1998 |
| WO | WO 00/32546 | 6/2000 |

* cited by examiner

ADDITIVES FOR IMPROVING THE COLD FLOW PROPERTIES AND THE STORAGE STABILITY OF CRUDE OIL

The present invention relates to an additive composition composed of flow improvers, poly-α-olefins and organic acids and also to their use for improving the cold flow and storage properties of crude oils.

Depending on their origin or the way in which they were processed, crude oils, residue oils, oil distillates, for example diesel fuel, mineral oils, lubricants, hydraulic fluids, etc., comprise greater or lesser proportions of n-paraffins and asphaltenes which present particular problems because they crystallize out and agglomerate when the temperature is reduced and may thus lead to deterioration in the flow properties of these oils. This deterioration in the flow properties of the oils is referred to as solidification of the oil. The pour point is the standard term for the temperature at which an oil, for example mineral oil, diesel fuel or hydraulic fluid, is still just able to flow as it is cooled. However, the pour point is not identical to the yield point. The yield point is a nonspecific term not covered by standards for the temperature at which a solid begins to flow under given measuring conditions. The deterioration in the flow properties may result in these oils blocking vessels, pipes, valves or pumps, for example in the course of transport, storage and/or processing, in particular in the case of paraffinic oils which are difficult to inhibit. Furthermore, paraffin precipitations require elevated pressures on re-start of pipelines (yield point).

Particular difficulties occur in practice when the wax appearance temperature (WAT) and in particular the intrinsic pour point of these oils is above ambient temperature, in particular at 20° C. or higher. In view of the decreasing world oil reserves and increasing exploitation of deposits which deliver crude oils having high intrinsic pour points, the conveyance and transport of such problematic oils are becoming ever more important.

There is a range of measures of thermal or mechanical nature for restoring or maintaining the flowability, for example scraping the crystallized paraffin from the pipe interior by regular pigging, heating entire pipelines or flushing procedures using solvents. A more elegant method is undoubtedly to combat the causes of the phenomenon by adding flow improvers which are also known as pour point depressants or paraffin inhibitors. In general, it is advantageous to depress the pour point to values below the respective ambient temperature, in particular to values of about 10° C. and below.

The way in which these flow improvers are effective is generally explained by their inhibition of the crystallization of paraffins and asphaltenes and by their cocrystallization with the paraffins or paraffin-asphaltene adducts which leads to the formation of smaller paraffin crystals which are no longer able to aggregate or form a network which impairs the flowability. The consequence is a reduction of the pour point and the maintenance of the flowability of the oil at low temperature. The effectiveness of the flow improvers depends both on their chemical construction (composition) and on their concentration.

U.S. Pat. No. 3,567,597 describes mineral oil distillates comprising crude oils, shale oils and residue oils which comprise, as pour point depressants, a copolymer which is a copolymer of ethylene and a vinyl ester of a saturated aliphatic $C_1$ to $C_{30}$-monocarboxylic acid and has an average molecular weight of from 4000 to 60,000 and comprises from 40 to 95% by weight of ethylene.

DE-A-20 57 168 discloses a process for reducing the frictional flux in oleaginous liquids flowing through pipelines and a shear-resistant additive effective in low concentrations with which the frictional losses in oleaginous liquids can be reduced. To this end, a small amount of at least one high molecular weight polymer which is derived from at least one α-olefin having from 6 to 20 carbon atoms (polyolefin) is added to the liquids.

EP-A-0 176 641 discloses that the properties of poly-α-olefins as flow accelerants for liquid hydrocarbons can be improved by carrying out the polymerization of the α-olefins by the Ziegler process in the presence of a dialkylaluminum halide and a trialkylaluminum compound.

GB-A-2 305 437 discloses pour point depressants for crude oils. These comprise a reaction product from an alkylphenol having on average more than 30 carbon atoms in the alkyl radical with an aldehyde having from 1 to 12 carbon atoms. These pour point depressants are suitable for treating crude oils which have a pour point of over 4° C.

EP-A-0 311 452 discloses additives for improving the cold flow behavior of fuels and lubricants. The additives comprise an alkylphenol-aldehyde resin which has a molecular weight of at least 3000 and from 6 to 50 carbon atoms in the alkyl radical and exhibits a specific distribution of the carbon chain lengths of the alkyl radicals.

U.S. Pat. No. 3,735,770 discloses a process for improving the flowability of crude oils under cold conditions. This process comprises the addition of copolymers of ethylene with unsaturated carboxylic esters, or of alkylphenols to the oil.

EP-A-0 857 776 discloses mixtures of ethylene copolymers and alkylphenol-formaldehyde resins, with or without paraffin dispersants (polar nitrogen compounds), for improving the cold properties of mineral oils. However, in paraffin-rich crude oils comprising long-chain paraffins, these mixtures do not show sufficient effectiveness.

A disadvantage of the known flow improvers for crude and residue oils is their insufficient effectiveness in many cases and the resulting high use concentrations, in particular in oils having a high proportion of long-chain n-paraffins having more than 30 carbon atoms. Furthermore, the known flow improvers support the sedimentation of the precipitated paraffin crystals of relatively high specific gravity by reducing the viscosity of the additivized oil. Although high molecular weight poly-α-olefins are able to improve the flow behavior of oils, they do not improve their cold behavior. A further disadvantage is the high intrinsic pour points of the flow improvers which require heating and/or very high dilution for the metering.

Additives are therefore sought which have improved properties as pour point depressants, i.e. still have sufficient effectiveness even at low dosage and, in comparison to prior art pour point depressants, have a lower intrinsic pour point at equally high concentration and are effective in a variety of oils, in particular in paraffinic oils. The additive shall reduce the cloud point, the viscosity and the yield point of the oil under cold conditions, and delay or prevent the sedimentation of the precipitated paraffin crystals.

It has now been found that, surprisingly, the required properties of the additive can be achieved by a ternary mixture of active ingredients.

The invention therefore provides additives for improving the flowability of mineral oils comprising A) from 1 to 40% by weight of at least one copolymer which is oil-soluble and is a cold-flow improver for mineral oils selected from A1) copolymers of from 80 to 96.5 mol % of ethylene and from 3.5 to 20 mol % of vinyl esters of carboxylic acids having from 1 to 20 carbon atoms and/or (meth)acrylic esters of alcohols having from 1 to 8 carbon atoms, and A2) homo- or copolymers of esters which bear $C_{10}$-$C_{30}$-alkyl radicals and are esters of ethylenically unsaturated carboxylic acids comprising up to 20 mol % of further olefinically unsaturated compounds, B) from 20 to 80% by weight of at least one poly-α-olefin having a molecular weight of from 250 to 5000 which is derived from monoolefins having from 3 to 5 carbon atoms, and C) from 5 to 70% by weight of at least one organic acid selected from C1) alkylphenol-aldehyde resins of the formula 1

(1)

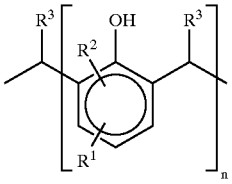

where $R^1$ and $R^2$ are each independently H or alkyl radicals having from 1 to 30 carbon atoms, but where both radicals may not at the same time be H, n is an integer from 3 to 50 and $R^3$ is H or an alkyl radical having from 1 to 4 carbon atoms, and C2) aliphatic and/or aromatic sulfonic acids of the formula $R^{18}$—$SO_3H$, where $R^{18}$ is $C_6$- to $C_{40}$-alkyl, $C_6$ to $C_{40}$-alkenyl or an alk(en)ylaryl radical which has 1, 2, 3 or 4 aromatic rings and 1, 2, 3 or 4 alkyl or alkenyl radicals each having from 6 to 40 carbon atoms.

The invention further provides mineral oils which comprise the mixtures of the components A), B) and C) described.

The invention further provides the use of this composition for improving the cold flow properties and storage stability of mineral oils.

The mixtures of the invention preferably comprise from 2 to 30% by weight, especially from 5 to 25% by weight, of copolymer A), from 25 to 70% by weight, especially from 30 to 60% by weight, of poly-α-olefin B), and from 5 to 65% by weight, especially from 10 to 50% by weight, of organic acid C).

The vinyl esters of the component A1) are generally of the formula 2

$$CH_2{=}CH{-}OCOR^4 \quad (2)$$

where $R^4$ is $C_1$-$C_{20}$-alkyl, preferably $C_1$-$C_{16}$-alkyl, especially $C_1$-$C_{12}$-alkyl. In a further preferred embodiment, $R^4$ is a neoalkyl radical having from 7 to 11 carbon atoms, in particular having 8, 9 or 10 carbon atoms. Suitable vinyl esters include vinyl acetate, vinyl propionate, 2-ethylhexyl vinyl ester, vinyl laurate, vinyl nononanoate, vinyl neodecanoate and vinyl neoundecanoate. Preference is given in particular to vinyl acetate and vinyl propionate.

The acrylic esters of the component A1) are preferably of the formula 3

$$CH_2{=}CR^5{-}COOR^6 \quad (3)$$

where $R^5$ is hydrogen or methyl and $R^6$ is $C_1$–$C_8$-alkyl, preferably $C_2$–$C_6$-alkyl. Suitable acrylic esters include methyl acrylate, ethyl acrylate, n- and isopropyl acrylate, n-, iso- and tert-butyl acrylate, and 2-ethylhexyl acrylate, and also the corresponding esters of methacrylic acid.

In addition to the vinyl and/or (meth)acrylic esters of the formulae 2 and 3, the copolymers of component A1) may also comprise up to 5 mol % of structural units of alkyl vinyl ethers and/or olefins. The alkyl vinyl ethers are preferably compounds of the formula 4

$$CH_2{=}CH{-}OR^7 \quad (4)$$

where $R^7$ is $C_1$–$C_{30}$-alkyl, preferably $C_1$–$C_{16}$-alkyl, especially $C_1$–$C_{12}$-alkyl.

The olefins are preferably alkenes having from 3 to 30, in particular from 3 to 10, carbon atoms. Examples of useful olefins include propene, butene, isobutene, pentene, hexene, isohexene, diisobutylene and norbornene.

The alkyl radicals $R^4$, $R^6$ and $R^7$ may bear minor amounts of functional groups, for example, amino, amido, nitro, cyano, hydroxyl, keto, carbonyl, carboxyl, ester or sulfonyl groups or halogen atoms, as long as these do not substantially detract from the hydrocarbon character of the radicals mentioned.

The molecular weight of the copolymers of component A1) is preferably from 1000 to 100,000 units which, according to DIN 53735, corresponds to MFI values of from 0.1 to 1000 g/10 min measured at 190° C. and a pressing force of 2.16 kg.

The ethylene content in copolymer A1) is from 80 to 96.5 mol %, preferably from 84 to 95 mol %. Component A1) preferably comprises relatively high molecular weight variants of what are known as flow improvers which are often added to middle distillates to improve the cold flow properties. In general, all known co- or terpolymers and their mixtures which taken alone improve the cold flow properties of mineral oils and mineral oil distillates can be used as copolymer A). Examples of suitable co- and terpolymers include:

the ethylene-vinyl acetate-hexene terpolymers disclosed by DE-A-34 43 475;

the ethylene-vinyl acetate-diisobutylene terpolymers described in EP-A-0 203 554;

the mixture of an ethylene-vinyl acetate-diisobutylene terpolymer and an ethylene-vinyl acetate copolymer disclosed by EP-A-0 254 284;

the mixtures of an ethylene-vinyl acetate copolymer and an ethylene-vinyl acetate-N-vinylpyrrolidone terpolymer disclosed in EP-A-0 405 270;

the ethylene-vinyl acetate/isobutyl vinyl ether terpolymers described in EP-A-0 463 518;

the mixed polymers of ethylene with vinyl alkylcarboxylates disclosed in EP-A-0 491 225;

the ethylene/vinyl acetate/vinyl neononanoate or vinyl neodecanoate terpolymers disclosed in EP-A-0 493 769 which, apart from ethylene, comprise 10–35% by weight of vinyl acetate and 1–25% by weight of the particular neocompound;

the terpolymers of ethylene, the vinyl ester of one or more aliphatic $C_2$–$C_{20}$-monocarboxylic acids and 4-methylpentene-1, described in DE-C-1 96 20 118;

the terpolymers of ethylene, the vinyl ester of one or more aliphatic $C_2$–$C_{20}$-monocarboxylic acids and bicyclo [2.2.1]heptene, disclosed in DE-C-196 20 119.

Mention should be made here in particular of ethylene/vinyl acetate, ethylene/vinyl propionate, ethylene/vinyl versatate, ethylene/vinyl acetate/vinyl versatate, ethylene/vinyl acetate/diisobutylene, ethylene/vinyl acetate/4-methylpentene and ethylene/vinyl acetate/isobutylene copolymers.

The copolymers A1) are prepared by known processes (c.f., for example, Ullmanns Encyclopädie der Technischen Chemie, 5th Edition, Vol. A 21, pages 305 to 413). Useful processes include polymerization in solution, in suspension or in the gas phase, and high pressure mass polymerization. Preference is given to applying high pressure mass polymerization which is carried out at pressures of from 50 to 400 MPa, preferably from 100 to 300 MPa, and temperatures of from 50 to 350° C., preferably from 100 to 300° C. The reaction of the comonomers is initiated by radical-forming initiators (radical chain initiators). Examples of compounds belonging to this substance class include oxygen, hydroperoxides, peroxides and azo compounds such as cumene hydroperoxide, t-butyl hydroperoxide, dilauroyl peroxide, dibenzoyl peroxide, bis(2-ethylhexyl) peroxydicarbonate, t-butyl permaleate, t-butyl perbenzoate, dicumyl peroxide, t-butylcumyl peroxide, di(t-butyl) peroxide, 2,2'-azo-bis(2-methylpropanonitrile), 2,2'-azo-bis (3-methylbutyronitrile). The initiators are used individually or as a mixture of two or more substances in amounts of from 0.01 to 20% by weight, preferably from 0.05 to 10% by weight, based on the comonomer mixture.

At a given composition of the comonomer mixture, the desired melt viscosity of the copolymers A1) is set by varying the reaction parameters pressure and temperature and optionally by adding moderators. Moderators which have proven useful include hydrogen, saturated or unsaturated hydrocarbons, for example propane, aldehydes, for example propionaldehyde, n-butyraldehyde or isobutyraldehyde, ketones, for example acetone, methyl ethyl ketone, methyl isobutyl ketone or cyclohexanone, or alcohols, for example butanol. Depending on the viscosity desired, the moderators are used in amounts of up to 20% by weight, preferably from 0.05 to 10% by weight, based on the comonomer mixture.

The high pressure mass polymerization is carried out batchwise or continuously in known high pressure reactors, for example autoclaves or tubular reactors,,and tubular reactors have proven particularly useful.

Solvents such as aliphatic hydrocarbons or hydrocarbon mixtures, benzene or toluene may be present in the reaction mixture, although solvent-free operation has proven particularly useful. In a preferred embodiment of the polymerization, the mixture of the comonomers, the initiator and, where used, the moderator is fed to a tubular reactor via the reactor entrance and also via one or more side branches. The comonomer streams may have different compositions (EP-B-0 271 738).

Preferred copolymers A2) comprise 80-100 mol % of the repeating structural element of the formula 5

(5)

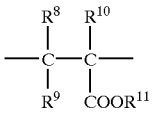

where $R^8$ and $R^9$ are each independently hydrogen, phenyl or a group of the formula $COOR^{11}$, $R^{10}$ is hydrogen, methyl or a group of the formula $—CH_2COOR^{11}$ and $R^{11}$ is a $C_{10}$- to $C_{30}$-alkyl or alkylene radical, preferably a $C_{12}$ to $C_{26}$-alkyl or alkylene radical, with the proviso that these repeating structural units comprise at least one and at most two carboxylic ester units in one structural element.

Copolymers where $R^8$ and $R^9$ are each hydrogen or a group of the formula $COOR^{11}$ and $R^{10}$ is hydrogen or methyl are particularly suitable. These structural units are derived from esters of monocarboxylic acids, for example acrylic acid, methacrylic acid, cinnamic acid, or from mono- or diesters of dicarboxylic acids, for example maleic acid, fumaric acid and itaconic acid. The esters of acrylic acid are particularly preferred.

Alcohols suitable for the esterification of the ethylenically unsaturated mono- and dicarboxylic acids are those having 10–30 carbon atoms, in particular those having 12–26 carbon atoms, for example 1-decanol, 1-dodecanol, 1-tridecanol, isotridecanol, 1-tetradecanol, 1-hexadecanol, eicosanol, docosanol, tetracosanol, hexacosanol and also naturally occurring mixtures, for example coconut fatty alcohol, tallow fatty alcohol and behenyl alcohol. The alcohols may be either of natural or synthetic origin.

In addition to $C_{10}$–$C_{30}$-alkyl esters of unsaturated carboxylic acids, the copolymers of component A2) may comprise up to 20 mol %, preferably up to 10 mol %, of comonomers such as vinyl esters of the formula 2, (meth)-acrylic esters of the formula 3, alkyl vinyl ethers of the formula 4 and/or olefins. Further useful comonomers in component A2) include in particular heteroatom-bearing ethylenically unsaturated compounds, for example allyl polyglycols, benzyl acrylate, hydroxyethyl acrylate, hydroxypropyl acrylate, hydroxybutyl acrylate, dimethylaminoethyl acrylate, perfluoroalkyl acrylate, and also the corresponding esters and amides of methacrylic acid, vinylpyridine, vinylpyrrolidone, acrylic acid, methacrylic acid, p-acetoxystyrene and vinyl methoxyacetate.

In preferred embodiments of the invention, allyl polyglycols may comprise from 1 to 50 EO or PO units and correspond to the formula 6

(6)

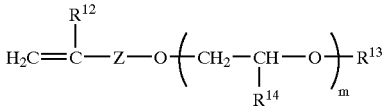

where $R^{12}$ is hydrogen or methyl,

Z is $C_1$–$C_3$-alkyl, $R^{13}$ is hydrogen, $C_1$–$C_{30}$-alkyl, cycloalkyl, aryl or $—C(O)—R^8$, $R^{14}$ is hydrogen or $C_1$–$C_{20}$-alkyl, $R^{15}$ is $C_1$–$C_{30}$-alkyl, $C_3$–$C_{30}$-alkenyl, cycloalkyl or aryl and m is a number from 1 to 50, preferably from 1 to 30.

Particular preference is given to comonomers of the formula 6 where $R^{12}$ and $R^{14}$ are each hydrogen and $R^{13}$ is hydrogen or a $C_1$–$C_4$-alkyl group.

The molecular weights and molar mass distributions of the copolymers according to the invention are characterized by a K value (measured according to Fikentscher in a 5% solution in toluene) of from 10 to 100, preferably from 15 to 80. The molecular weights Mw may be in the range from 2000 to 500,000, preferably from 5000 to 300,000, and be determined, for example, by means of gel permeation chromatography against polystyrene standards.

The copolymers A2) are prepared by (co)polymerization of esters of ethylenically unsaturated carboxylic acids, in particular (meth)acrylates, optionally with further comonomers by customary free radical polymerization processes.

A suitable preparation process consists in dissolving the monomers in an organic solvent and polymerizing them in the presence of a radical initiator at temperatures in the range from 30 to 150° C. Useful solvents include aromatic hydrocarbons, for example toluene, xylene, trimethylbenzene, dimethylnaphthalene and mixtures of these aromatic hydrocarbons. Commercial mixtures of aromatic hydrocarbons, for example Solvent Naphtha or Shellsol AB® (manufacturer: Shell), also find use. Aliphatic hydrocarbons are likewise useful solvents. Alkoxylated aliphatic alcohols or their esters, for example butyl glycol, find use as solvents, but preferably as a mixture with aromatic hydrocarbons.

The radical initiators used are customarily conventional initiators such as azobisisobutyronitrile, esters of peroxycarboxylic acids, for example t-butyl perpivalate or t-butyl per-3-ethylhexanoate, or dibenzoyl peroxide.

The polymers which form component B are poly-α-olefins which can be derived from monoolefins having 3, 4 or 5 carbon atoms. Monoolefins which are used with particular preference as basic units of suitable polyolefins are propylene and isobutylene, which form the polyolefins polypropylene and polyisobutylene. They may further comprise minor amounts, preferably less than 10 mol %, of relatively long-chain α-olefins having from 6 to 50, preferably from 12 to 40, carbon atoms. Examples of useful olefins include 1-dodecene, 1-tetradecene, 1-tridecene, 1-hexadecene, 1-heptadecene, 1-octadecene, 1-nonadecene, 1-eicosene, 1-hemicosene, 1-docosene, 1-tetracosene, 1-hexacosene, 1-octacosene, etc., and also their mixtures.

The polyolefins B) are accessible by ionic polymerization and obtainable as commercial products (for example ®Ultravis, ®Napvis, ®Hyvis, ®Glissopal) (polyisobutenes from BP, BASF having different alkylvinylidene contents and molecular weights).

The distribution of the olefin isomers resulting from different polymerization processes is generally of limited importance for the use according to the invention, although in special cases poly-α-olefins having an increased alkylvinylidene content of more than 50 mol %, in particular more than 70 mol %, have proven advantageous.

The alkylvinylidene content is the content of structural units in the polyolefins which have terminal double bonds and are based on compounds of the formula 7

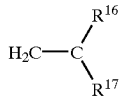

(7)

where $R^{16}$ or $R^{17}$ are each methyl or ethyl and the other group is an oligomer of the $C_3$–$C_5$-olefin. The number of carbon atoms of the poly-α-olefin is from 35 to 350. In a preferred embodiment of the invention, the number of carbon atoms is from 45 to 250.

Component C1) is an alkylphenol-aldehyde resin. These are known in principle and described, for example, in R ömpp Chemie Lexikon, 9th Edition, Thieme Verlag 1988-92, Volume 4, p. 3351 ff.

The alkyl radicals $R^1$ and $R^2$ of the alkylphenol in the alkylphenol-aldehyde resins C1) used in the additive according to the invention may be the same or different and have from 1 to 30, preferably from 4 to 20, carbon atoms; they are preferably n-, i- and tert-butyl, n- and i-pentyl, n- and i-hexyl, n- and i-octyl, n- and i-nonyl, n- and i-decyl, n- and i-dodecyl, tripropenyl, tetrapropenyl and pentapropenyl. The phenol is preferably monoalkylated.

The aliphatic aldehyde in the alkylphenol-aldehyde resin C1) has from 1 to 4 carbon atoms and is preferably formaldehyde. The average molecular weight of the alkylphenol-aldehyde resins is preferably 400–10,000 g/mol, in particular 400–5000 g/mol. A prerequisite is that the resins are oil-soluble.

The alkylphenol-aldehyde resins C1) are prepared in a known manner by basic catalysis to give condensation products of the resol type or by acid catalysis to give condensation products of the novolak type.

The condensates obtained in both ways are suitable as additive component C1). Preference is given to condensation in the presence of acid catalysts. To prepare the alkylphenol-aldehyde resins, a mono- and/or dialkylphenol having from 1 to 30 carbon atoms, preferably from 4 to 20 carbon atoms, per alkyl group, or mixtures thereof and an aliphatic aldehyde having from 1 to 4 carbon atoms are reacted with each other using about 0.5–2 mol, preferably 0.7–1.3 mol, of aldehyde per mole of alkylphenol compound.

Useful alkylphenols are in particular $C_4$–$C_{20}$-alkylphenols, for example o- or p-cresol, n-, sec- and tert-butylphenol, n- and i-pentylphenol, n- and i-hexylphenol, n- and i-octylphenol, n- and i-nonylphenol, n- and i-decylphenol, n- and i-dodecylphenol, tripropenylphenol, tetrapropenylphenol and pentapropenylphenol. The corresponding dialkylated phenols are equally suitable and the alkyl radicals may be the same or different.

Particularly useful aldehydes are formaldehyde, acetaldehyde and butyraldehyde, and preference is given to formaldehyde. The formaldehyde may be used in the form of paraformaldehyde or in the form of a preferably from 20 to 40% by weight aqueous formalin solution. Corresponding amounts of trioxane may also be used.

Alkylphenol and aldehyde are customarily reacted in the presence of alkaline catalysts, for example alkali metal hydroxides or alkylamines, or of acid catalysts, for example inorganic or organic acids, such as hydrochloric acid, sulfuric acid, phosphoric acid, sulfonic acids, sulfamido acids or haloacetic acids, and in the presence of an organic solvent forming an azeotrope with water, for example toluene, xylene, higher aromatics or mixtures thereof. The reaction mixture is heated to a temperature of from 90 to 200° C., preferably 100–160° C., and the resulting water of reaction is removed during the reaction by azeotropic distillation. Solvents which do not release protons under the condensation conditions may remain in the products after the condensation reaction. The resins may be used directly or after neutralization of the catalyst, optionally after further dilution of the solution with aliphatic and/or aromatic hydrocarbons or hydrocarbon mixtures, for example petroleum fractions, kerosene, decane, pentadecane, toluene, xylene, ethylbenzene or solvents such as ®Solvent Naphtha, ®Shellsol AB, ®Solvesso 150, ®Solvesso 200, ®Solvesso 250, ®Exxsol, ®ISOPAR and Shellsol D types.

Component C2) is an organic, oil-soluble sulfonic acid or its metal or ammonium salt, preferably alkali metal salt. Preference is given to aliphatic sulfonic acids such as alkanesulfonates having from 8 to 30, more preferably from 10 to 26, in particular from 12 to 24, carbon atoms. The sulfonic group may be terminal or bonded to a methylene group of the hydrocarbon chain. Preference is further given to aromatic sulfonic acids having one or two $C_8$- to $C_{30}$-, in particular $C_{12}$- to $C_{24}$-alkyl or alkenyl radicals and one or two aromatic rings. The alkyl or alkenyl radicals may be linear or branched and be bonded to any desired point on the aromatic. They are preferably in the para-position to the sulfonic group in systems monosubstituted by alkyl or alkenyl radicals and in the ortho- and para-position to the sulfonic group in systems disubstituted with alkyl or alkenyl radicals. Examples include: nonylbenzenesulfonic acid, dodecylbenzenesulfonic acid, nonylnaphthalenesulfonic acid, dinonylbenzenesulfonic acid and didodecylbenzenesulfonic acid.

For the purposes of the invention, oil-soluble means that at least 10% by weight, preferably at least 1% by weight, in particular at least 0.1% by weight, of the additive is clearly soluble in the middle distillate to be additivized. This definition is to be applied correspondingly when the term oil-soluble is used elsewhere. The additives according to the invention are suitable in particular for improving the flowability and paraffin sedimentation of crude oils and other paraffinic mineral oils whose paraffin sediments comprise relatively large proportions (preferably more than 20 area % by GC, in particular from 30 to 60 area %, especially from 40 to 50 area %) of n-paraffins having carbon chain lengths of 30 and more carbon atoms. These oils are generally darkly colored by asphaltenes and resins, although they are preferably transparent. The additives according to the invention are further able to reduce the yield point of the additivized oils and therefore to ease the restart of pipelines.

The additive components according to the invention may be added to the mineral oils separately or in a mixture. For improving the ease of handling, solutions or dispersions which comprise from 10 to 90% by weight, preferably from 20 to 80% by weight, of the additives or additive combination have proven particularly useful. Useful solvents or dispersants are aliphatic and/or aromatic hydrocarbons or hydrocarbon mixtures, for example petroleum fractions, kerosene, decane, pentadecane, toluene, xylene, ethylbenzene or commercial solvent mixtures such as Solvent Naphtha, ®Shellsol AB, ®Solvesso 150, ®Solvesso 200, ®Exxsol, ®ISOPAR and ®Shellsol D types and also aliphatic or aromatic alcohols, ethers and/or esters. Mineral oils whose cold flow properties have been improved by the additive combination comprise from 0.001 to 1% by weight, preferably from 0.01 to 0.5% by weight, of the additive combination based on the mineral oil.

The additives according to the invention or the oils additivized with them may comprise further cold additives, for example polar nitrogen compounds or polyoxyalkylene ethers. Furthermore, they may comprise corrosion inhibitors, detergent additives, defoamers, demulsifiers, asphalt dispersants and other additives. These additives may be added to the oil together with the additive components according to the invention or separately.

EXAMPLES

1. Characterization of the Additives Used

The following flow improvers were used as component A):

A1: Ethylene-vinyl acetate copolymer having 11.2 mol % of vinyl acetate and an MFI of 7 g/10 min A2: Stearyl acrylate-allyl polyglycol copolymer composed of 95% by weight of acrylic ester and 5% by weight of allyl polyglycol (7 EO), K=33, measured in 5% by weight solution in toluene.

A3: Ethylene-vinyl acetate copolymer having 7.1 mol % of vinyl acetate, MFI 12 g/10 min The following polyolefins (polyisobutylenes) were used as component B):

B1: Glissopal 1000 (BASF), M=1000 g/mol, viscosity at 100° C.=215 mPas, alkylvinylidene content 85 mol %

B2: ®Hyvis 5 (BP), M=780 g/mol, viscosity at 100° C.=103 mPas

B3: Hyvis 30 (BP), M=1300 g/mol, viscosity at 100° C.=635 mPas

B4: Hyvis 200 (BP) M=2600 g/mol, viscosity at 100° C.=4250 mPas

B5: Polyisobutylene M=3000 g/mol, viscosity at 100° C.=600–670 mPas measured according to ASTM D445

The following organic acids were used as component C):

C1): Alkylphenol-aldehyde resin according to DE 3 142 955, condensation product of p-n-nonylphenol and formaldehyde prepared under acid catalysis having from 5 to 8 p-n-nonylphenol units C2): Dodecylbenzenesulfonic acid C3): Sodium dodecylbenzenesulfonate Using the above-defined components A, B and C, the following additives were prepared:

TABLE 1

| | Additive compositions | | | |
|---|---|---|---|---|
| | Weight proportion of the components | | | |
| Example No. | A | B | C | D* |
| 1 | 1 (A1) | 2 (B1) | 2 (C1) | — |
| 2 | 1 (A1) | 2 (B1) | 1 (C1) | 1 |
| 3 | 2 (A1) | 1 (B1) | 2 (C1) | — |
| 4 | 1 (A1) | 1 (B1) | 1 (C1) | — |
| 5 | 2 (A1) | 1 (B1) | 1 (C1) | — |
| 6 | 1 (A2) | 2 (B1) | 2 (C1) | — |
| 7 | 1 (A3) | 2 (B1) | 2 (C1) | — |
| 8 | 1 (A1) | 2 (B2) | 2 (C1) | — |
| 9 | 1 (A1) | 2 (B3) | 2 (C1) | — |
| 10 | 1 (A1) | 2 (B4) | 2 (C1) | — |
| 11 | 1 (A1) | 43 (B5) | 10 (C2) | — |
| 12 | 1 (A1) | 43 (B5) | 10 (C3) | — |

*Component D in Example 2 was an oxalkylated polyamine

2. Crude Oil Characteristics 2.1 Oil

Origin Kazakhstan

Pour point <−30° C.

W.A.T./cloud point +39° C.

2.2 Sediment

Ratio of iso-n-paraffin 1:2.5 (see Table 2)

Softening point (S.P.) 62.5° C.

Oil content (% by weight) 31

$D_{70}$ (kg/m$^3$) 799.2

$n_{D100}$ 1.4370

$V_{100}$ (mm$^2$/s) 3.1

Boiling range (° C.) 115–720 (about 50% of the n-paraffins distil at between 420–720° C., see Table 3)

TABLE 2

| | Paraffin chain length distribution of the sediment in % by weight | | | | | | | | | | | | | | |
|---|---|---|---|---|---|---|---|---|---|---|---|---|---|---|---|
| Chain length | $C_{10}$ | $C_{11}$ | $C_{12}$ | $C_{13}$ | $C_{14}$ | $C_{15}$ | $C_{16}$ | $C_{17}$ | $C_{18}$ | $C_{19}$ | $C_{20}$ | $C_{21}$ | $C_{22}$ | $C_{23}$ | $C_{24}$ |
| n | 2.2 | 2.5 | 2.0 | 1.8 | 1.7 | 1.5 | 1.1 | 0.8 | 0.8 | 0.9 | 0.8 | 0.8 | 0.6 | 0.8 | 0.6 |
| iso | 5.0 | 3.4 | 4.1 | 2.9 | 2.2 | 1.4 | 1.1 | 1.4 | 0.9 | 0.3 | 0.4 | 0.3 | 0.3 | 0.1 | 0.1 |

TABLE 2-continued

| Paraffin chain length distribution of the sediment in % by weight | | | | | | | | | | | | | | | |
|---|---|---|---|---|---|---|---|---|---|---|---|---|---|---|---|
| Chain length | $C_{25}$ | $C_{26}$ | $C_{27}$ | $C_{28}$ | $C_{29}$ | $C_{30}$ | $C_{31}$ | $C_{32}$ | $C_{33}$ | $C_{34}$ | $C_{35}$ | $C_{36}$ | $C_{37}$ | $C_{38}$ | $C_{39}$ |
| n | 0.7 | 0.8 | 1.0 | 1.3 | 1.6 | 2.0 | 2.1 | 2.3 | 2.3 | 2.3 | 2.3 | 2.4 | 2.5 | 2.7 | 2.8 |
| iso | 0.0 | 0.1 | 0.0 | 0.1 | 0.1 | 0.0 | 0.1 | 0.1 | 0.1 | 0.2 | 0.3 | 0.2 | 0.2 | 0.2 | 0.2 |
| Chain length | $C_{40}$ | $C_{41}$ | $C_{42}$ | $C_{43}$ | $C_{44}$ | $C_{45}$ | $C_{46}$ | $C_{47}$ | $C_{48}$ | $C_{49}$ | $C_{50}$ | $C_{51}$ | $C_{52}$ | $C_{53}$ | $C_{54}$ |
| n | 3.0 | 2.9 | 3.0 | 2.9 | 2.6 | 2.2 | 1.8 | 1.6 | 1.1 | 0.9 | 0.6 | 0.5 | 0.4 | 0.3 | 0.2 |
| iso | 0.3 | 0.4 | 0.4 | 0.3 | 0.3 | 0.4 | 0.3 | 0.2 | 0.0 | 0.0 | 0.0 | 0.0 | 0.0 | 0.0 | 0.0 |

TABLE 3

| Boiling behavior of the crude oil used in ° C. | |
|---|---|
| Start of boiling | 115.9 |
| 2% by weight | 119.7 |
| 5% by weight | 139.6 |
| 10% by weight | 172.4 |
| 50% by weight | 419.5 |
| 90% by weight | 599.5 |
| 95% by weight | 636.8 |
| End of boiling | 720.5 |

1.3 Reduction of the Yield Point

The yield point is a measure of the force which has to be applied to transfer the solidified crude oil back into the flowing state (restartability). In the case of the untreated oil, a force of about 2.2 Pa has to be applied at −20° C., while treated crude oil (500 ppm, Example 1) only requires 0.6–0.7 Pa at the same temperature.

TABLE 4

| Yield point in Pa for untreated crude oil and for crude oil having 500 ppm of additive according to Example 1, 3, 5 or 6 | | | | | |
|---|---|---|---|---|---|
| Temperature | Untreated crude oil | Example 1 | Example 3 | Example 5 | Example 6 |
| −20 | 2.2 | 0.7 | 0.95 | 0.9 | 0.6 |
| −15 | 1.55 | 0.6 | 0.8 | 0.7 | 0.5 |
| −10 | 1 | 0.25 | 0.3 | 0.3 | 0.2 |
| −5 | 0.75 | 0.1 | 0.1 | 0.1 | 0.1 |
| 0 | 0.4 | 0.05 | 0.05 | 0.05 | 0.05 |

4. Reduction of the Viscosity (m Pas)

The viscosities were recorded in the temperature range from +50 to −20° C. Clear differences occur between the blank value and the crude oil sample treated with 500 ppm of additive according to Example 1 or 6; a few viscosities are compared by way of example:

TABLE 5

| Viscosities in mPas | | |
|---|---|---|
| Sample | Temperature | Viscosity |
| untreated crude oil | 0 | 12 |
| untreated crude oil | −10 | 26 |
| untreated crude oil | −20 | 45 |
| crude oil + 500 ppm of additive Ex. 1 | 0 | 6 |

TABLE 5-continued

| Viscosities in mPas | | |
|---|---|---|
| Sample | Temperature | Viscosity |
| crude oil + 500 ppm of additive Ex. 1 | −10 | 23 |
| crude oil + 500 ppm of additive Ex. 1 | −20 | 34 |
| crude oil + 500 ppm of additive Ex. 3 | 0 | 7 |
| crude oil + 500 ppm of additive Ex. 3 | −10 | 24 |
| crude oil + 500 ppm of additive Ex. 3 | −20 | 36 |
| crude oil + 500 ppm of additive Ex. 5 | 0 | 6 |
| crude oil + 500 ppm of additive Ex. 5 | −10 | 22 |
| crude oil + 500 ppm of additive Ex. 5 | −20 | 32 |
| crude oil + 500 ppm of additive Ex. 6 | 0 | 4 |
| crude oil + 500 ppm of additive Ex. 6 | −10 | 20 |
| crude oil + 500 ppm of additive Ex. 6 | −20 | 31 |

Not only is the viscosity reduced by the addition of additive according to Example 1 or 6, but the location of the plateau which can be recognized in the untreated crude oil is shifted in an advantageous manner.

The viscosity plateau occurring on cooling the crude oil can be attributed to the paraffin crystallization occurring to an increased extent from a certain temperature. In the case of the sample treated with 500 ppm of the additive according to Example 1 or 6, the plateau occurring in the untreated sample appears to be distinctly less marked and occurs only at −9° C. instead of at −5° C.

5. Sedimentation (Laboratory Tests)

Procedure: 50 ml in each case of the test crude oil are charged to a torpedo glass, heated to 70° C. and admixed with 500 ppm of the additives (Examples 1 to 6). The oil samples are then agitated for 5 minutes on the agitating machine (250 strokes/min) and then stored at 21° C. or 0° C. The samples are evaluated by visual assessment (ml of sediment/appearance of the liquid phase, etc.; see table) of the sample after and before centrifugation.

TABLE 6

| Sample Example No. | Sediment (ml) | Appearance of the liquid phase | Storage temp. (° C.) | Storage time (h) | Dispersion D (%) | Comments |
|---|---|---|---|---|---|---|
| | | | Sedimentation behavior | | | |
| Crude oil | 7 | cloudy | 21 | 168 | 0 | not centrifuged |
| (blank | 4.5 | opalescent | 21 | 168 | 0 | centrifuged (2000 pm/min) |
| value) | 5 | clear | 0 | 24 | 0 | not centrifuged |
| Ex. 1 | 1 | clear | 21 | 168 | 86 | not centrifuged |
| | 0.9 | clear | 21 | 168 | 80 | centrifuged (2000 rpm/5 min) |
| | 1.2 | cloudy | 0 | 24 | 76 | not centrifuged |
| | 3.0 | clear | 21 | 168 | 33 | 20 h at 0° C. then heating to 21° C. |
| Ex. 2 | 1.50 | clear | 21 | 168 | 67 | centrifuged (2000 rpm/5 min) |
| Ex. 3 | 1.8 | clear | 21 | 168 | 60 | centrifuged (2000 rpm/5 min) |
| Ex. 4 | 1.5 | clear | 21 | 168 | 67 | centrifuged (2000 rpm/5 min) |
| Ex. 5 | 1.8 | clear | 21 | 168 | 60 | centrifuged (2000 rpm/5 min) |
| Ex. 6 | 1.8 | clear | 21 | 168 | 60 | centrifuged (2000 rpm/5 min) |
| Ex. 7 | 1.5 | clear | 21 | 168 | 79 | centrifuged (2000 rpm/5 min) |
| Ex. 8 | 1.5 | clear | 21 | 168 | 79 | centrifuged (2000 rpm/5 min) |
| Ex. 9 | 1.0 | clear | 21 | 168 | 86 | centrifuged (2000 rpm/5 min) |
| Ex. 10 | 1.2 | clear | 21 | 168 | 83 | centrifuged (2000 rpm/5 min) |
| Ex. 11 | 1.0 | clear | 21 | 168 | 80 | centrifuged (2000 rpm/5 min) |
| Ex. 12 | 1.5 | clear | 21 | 168 | 70 | centrifuged (2000 rpm/5 min) |

$$\text{dispersion D} = \frac{\text{sediment (untreated)} - \text{sediment (treated)}}{\text{sediment (untreated)}}$$

6. Comparative Experiments

In order to demonstrate the superiority of the compositions according to the invention over the prior art, the components A, B and C of the composition according to the invention were used alone or in combinations of two to improve the cold flow properties of crude oil. In the following table, the yield point (YP), viscosity (V) and dispersion (D) as previously described are presented for the specified compositions. The dosage amount of additive was always 500 ppm.

TABLE 7

| Ex. | A | B | C | YP (−10° C.) | V (−20° C.) | D (centrifuged) |
|---|---|---|---|---|---|---|
| | | | Comparative experiments | | | |
| C1 | 500 (A1) | — | — | 0.9 | 45 | 5 |
| C2 | — | 500 (B1) | — | 0.95 | 43 | 5 |
| C3 | — | — | 500 | 0.92 | 45 | 7 |
| C4 | 500 (A2) | — | — | 0.88 | 42 | 9 |
| C5 | 250 (A2) | — | 250 | 0.7 | 41 | 12 |
| C6 | 250 (A2) | 250 (B1) | — | 0.75 | 41 | 11 |
| C7 | — | 250 (B1) | 250 | 0.76 | 42 | 12 |

What is claimed is:

1. An additive for improving the flowability of mineral oils comprising

A) from 1 to 40% by weight of at least one copolymer which is oil-soluble and is a cold-flow improver for mineral oils selected from A1) copolymers of from 80 to 96.5 and mol % of ethylene and from 3.5 to 20 mol % of vinyl esters of carboxylic acids having from 1 to 20 carbon atoms and/or (meth) acrylic esters of alcohols having from 1 to 8 carbon atoms, and A2) homo- or copolymers of esters having $C_{10}$–$C_{30}$-alkyl radicals and are esters of ethylenically unsaturated carboxylic acids comprising up to 20 mol % of further olefinically unsaturated compounds, B) from 20 to 80% by weight of at least one poly-α-olefin having a molecular weight of from 250 to 5000 which is derived from monoolefins having from 3 to 5 carbon atoms, and C) from 5 to 70% by weight of at least one organic acid selected from C1) alkylphenol-aldehyde resins of the formula 1

(1)

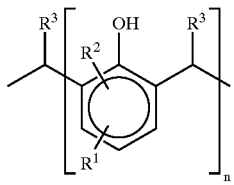

where $R^1$ and $R^2$ are each independently H or alkyl radicals having from 1 to 30 carbon atoms, but where both radicals may not at the same time be H, n is an integer from 3 to 50 and $R^3$ is H or an alkyl radical having from 1 to 4 carbon atoms, and C2) aliphatic and/or aromatic sulfonic acids of the formula $R^{18}$—$SO_3H$, where $R^{18}$ is $C_6$- to $C_{40}$-alkyl, $C_6$ to $C_{40}$-alkenyl or an alk(en)ylaryl radical which has 1, 2, 3 or 4 aromatic rings and 1, 2, 3 or 4 alkyl or alkenyl radicals each having from 6 to 40 carbon atoms.

2. The additive as claimed in claim 1, wherein component A1 is a copolymer of ethylene and vinyl acetate or vinyl propionate.

3. The additive as claimed in claim 1, wherein component A1 is a copolymer which comprises up to 5 mol % of structural units which are derived from alkyl vinyl ethers and/or olefins.

4. The additive as claimed in claim 1, wherein from 80 to 100 mol % of component A2 consists of a structural element of the formula 5

(5)

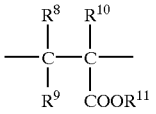

where $R^8$ and $R^9$ are each independently hydrogen, phenyl or a group of the formula $COOR^{11}$, $R^{10}$ is hydrogen, methyl or a group of the formula $—CH_2COOR^{11}$ and $R^{11}$ is a $C_{10}$- to $C_{30}$-alkyl or alkylene radical, with the proviso that the structural element comprises at least one and at most two carboxylic ester units.

5. The additive as claimed in claim 1, wherein component B is a polypropylene or polyisobutylene.

6. The additive as claimed in claim 1, wherein component C is derived from a monoalkylated phenol having from 4 to 20 carbon atoms in the alkyl chain.

7. The additive as claimed in claim 1, wherein component C1 has been condensed using formaldehyde.

8. The additive as claimed in claim 1, wherein component C2 is an alk(en)ylarylsulfonic acid having one or two $C_8$- to $C_{30}$-alkyl or alkenyl radicals and 1 or 2 aromatic rings, or a salt thereof.

9. A mineral oil comprising from 0.001 to 1% by weight of an additive as claimed in claim 1.

10. A process for improving the cold flow properties and the storage stability of a mineral oil comprising adding to the mineral oil the additive of claim 1.

11. The additive of claim 4 wherein $R^{11}$ is a $C_{12}$ to $C_{26}$-alkyl or alkylene radical.

* * * * *